US005362165A

United States Patent [19]

Kluga et al.

[11] Patent Number: 5,362,165

[45] Date of Patent: Nov. 8, 1994

[54] CONCRETE HAND EDGER TOOL WITH WATER SPRAY

[75] Inventors: Mark L. Kluga, 15605 Idlewood, Libertyville, Ill. 60048; Robert A. Kluga, Mundelein, Ill.

[73] Assignee: Mark L. Kluga, Libertyville, Ill.

[21] Appl. No.: 129,264

[22] Filed: Sep. 30, 1993

[51] Int. Cl.[5] ..... B05L 17/10; E01C 19/12; A62C 8/00

[52] U.S. Cl. ..... 401/9; 401/139; 15/235.8; 15/235.4; 239/330; 239/525

[58] Field of Search ..... 239/289, 327, 329, 330, 239/525, 576; 15/235.4–235.8; 401/5, 9, 48, 136–139

[56] References Cited

U.S. PATENT DOCUMENTS

| | | | |
|---|---|---|---|
| 2,490,440 | 12/1949 | Jacobs | 401/137 X |
| 3,025,005 | 3/1962 | Dafforol et al. | 239/496 X |
| 3,045,271 | 7/1962 | Cinotti | 15/235.8 |
| 3,458,265 | 7/1969 | Andriani | 401/139 |

FOREIGN PATENT DOCUMENTS

| | | | |
|---|---|---|---|
| 660646 | 2/1964 | Italy | 401/139 |

*Primary Examiner*—Danton D. DeMille
*Attorney, Agent, or Firm*—Juettner Pyle Lloyd & Piontek

[57] ABSTRACT

A concrete corner edger or hand tool has a smoothing blade attached to a handle together with a water supply and an integral water sprayer, with the water sprayer being disposable over either end of the tool.

4 Claims, 2 Drawing Sheets

10
16
18
20
22
23
24
26
28
28
30
32
34
36
38
40
42
44
46
48
52
54
56
58
58
60
62
64
66

CONCRETE HAND EDGER TOOL WITH WATER SPRAY

BACKGROUND OF THE INVENTION

This invention relates to the trowel or edger which is employed by a mason as a hand tool to finish uncured concrete or similar materials.

Edge finishing tools generally comprise a blade having a flat rectangular portion and a downwardly curved portion along one of the longer edges. The blade is attached to a long U-shaped handle and is used to smooth and finish fresh cement. In order to provide a smooth surface, it is necessary to rewet the concrete surface, and this is done separately, usually by dipping a brush in a container of water and splashing water onto the surface to be finished. The blade is then moved across the surface to provide a smooth corner. It will be apparent that the application of water by the foregoing method is not uniform and may result in surface voids and irregularities.

It has been known to employ water sprays in motor driven concrete floor finishing machines, see U.S. Patent No. 5,024,384, but there have been no proposals of the use of a water sprayer attached to or associated with a hand finishing tool.

SUMMARY OF THE INVENTION

In accordance with the present invention, a masonry hand tool in the form of a trowel or edger has a rectangular blade with opposed ends, and a longitudinal handle. A water spray nozzle is provided on the handle and is directed downward and outwardly in a direction beyond one of the ends of the blade.

Means are provided to supply water under pressure to the spray nozzle in an intermittent fashion. A water tank may be provided between the blade and the handle, a manually operated pump having a squeeze bulb for operation may be located in the handle, preferably in the region where the handle is grasped by the hand. Water is sprayed in the advance path of the edger.

If the edger has a curved blade portion, the tool could only be used in one direction, namely, the direction of the water spray. To overcome this problem, means are provided to unlock the handle and tank assembly from the blade, and to allow rotation of the handle until the water spray is directed over the other end of the blade.

The hand tool or edger of the present invention is versatile and self contained, and allows a carefully controlled fine spray of water to be applied to the concrete or similar surface as the surface is being finished, and without resorting to a separate operation with a brush.

DESCRIPTION OF THE PREFERRED EMBODIMENT

Figure 1:
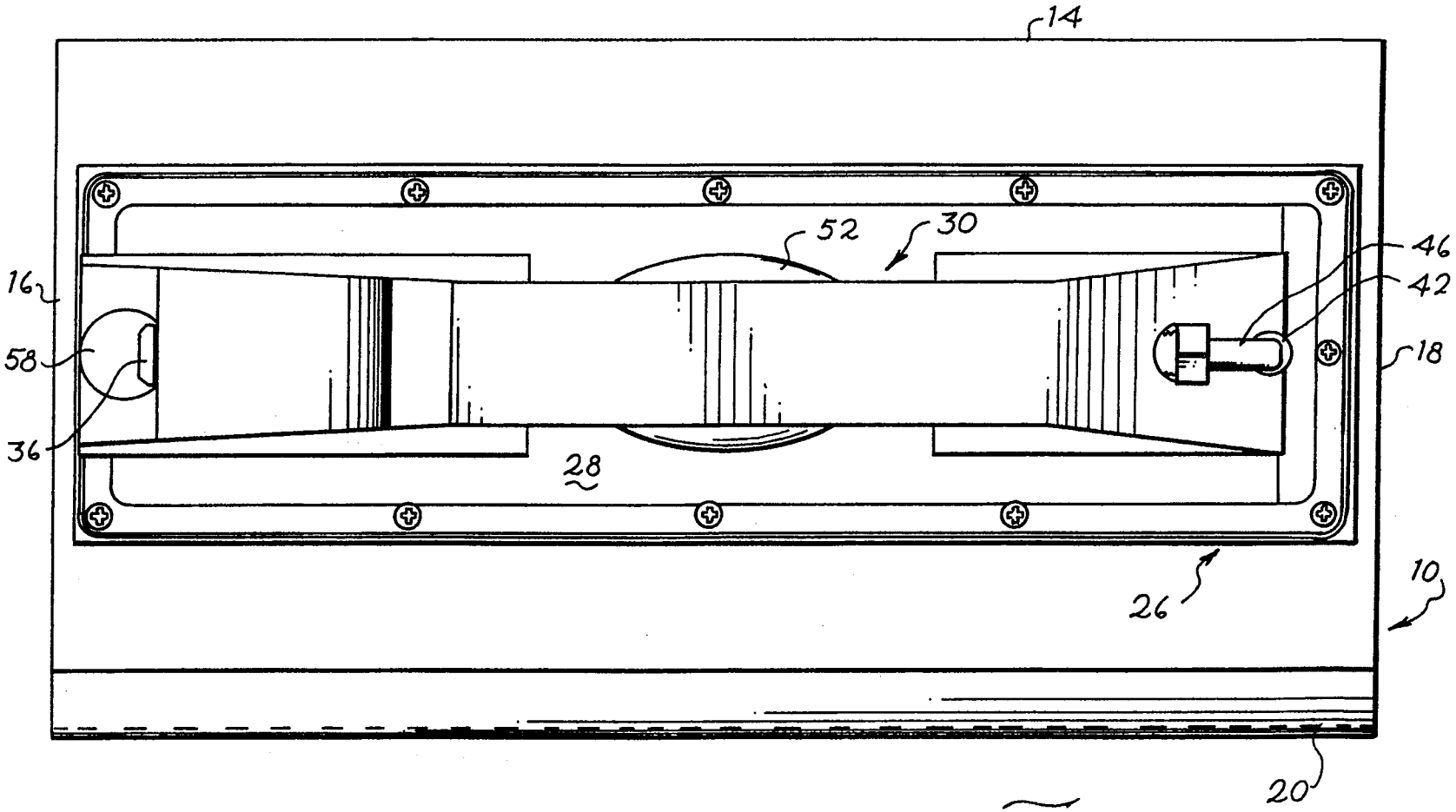
FIG. 1 is a top plan view of the edger of the present invention.
Figure 3:
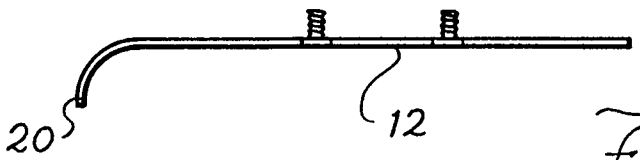
FIG. 3 is an end view of the blade of the edger of the present invention.
Figure 2:
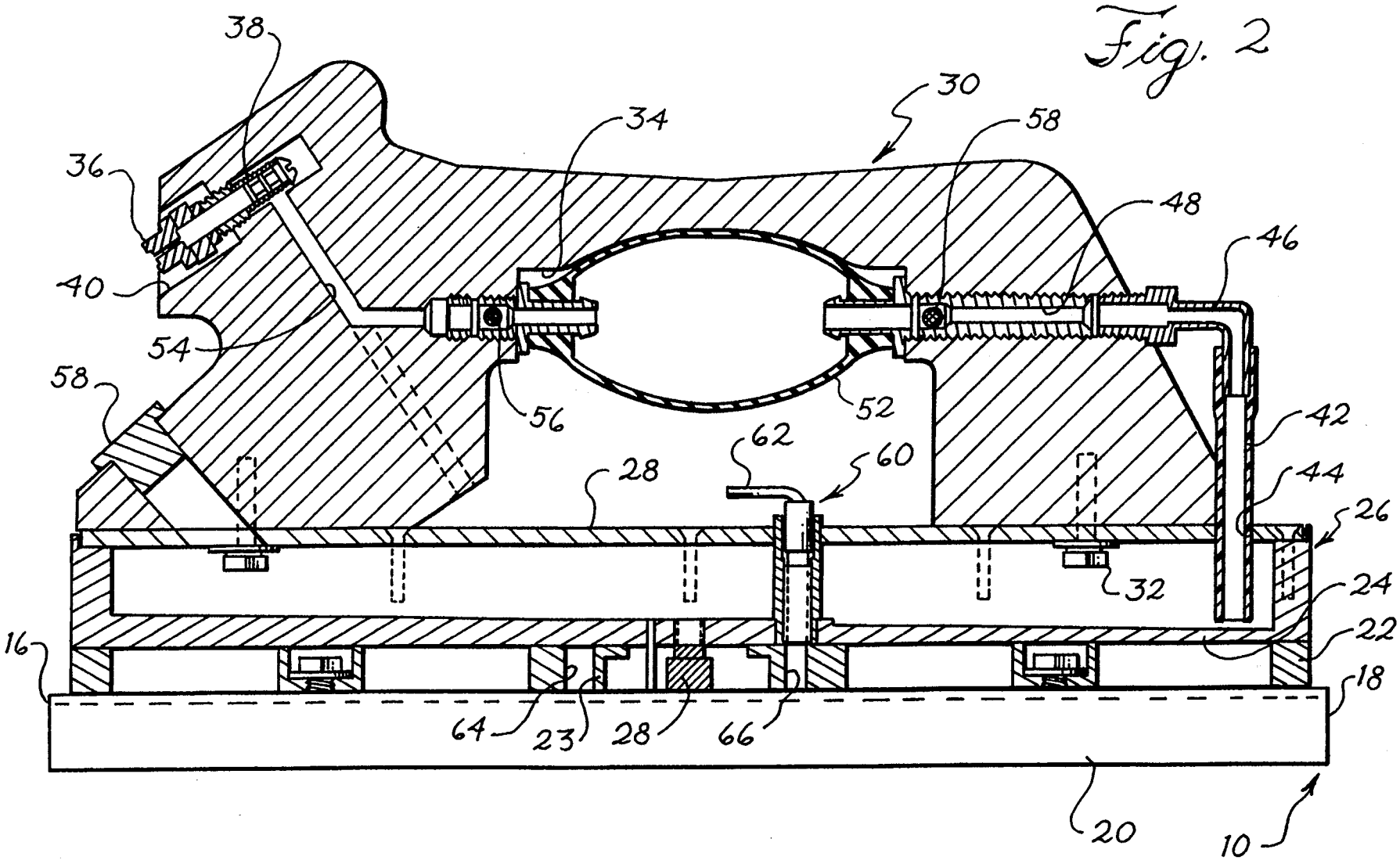
FIG. 2 is a vertical sectional view through the device shown in FIG. 1, with the exception of the blade, which is shown in elevation.

As shown in FIGS. 1–3, the tool of the present invention comprises a blade 10 having a downwardly facing flat rectangular surface 12, an elongate straight side edge 14 and shorter end edges 16 and 18. The other side edge 20 is curved downwardly along its length to allow smoothing of a corner during the finishing operation.

The blade 10 is secured to a spacer base 22 by means of nuts and bolts as shown. The spacer base 22 comprises a central upstanding boss 23 to support the base wall 24 of a rectangular water tank 26. The blade 10 and spacer base 22 are pivotally connected to the water tank 26 by means of a central pivot pin 28 depending from base wall 24 and having its lower end resting on the upper surface of the blade.

As shown, the tank 26 comprises a transparent top wall 28 to complete a closed vessel for the storage of water. The inner surface of the bottom wall 24 is sloped downwardly toward one end to accumulate water at a pick-up region.

An elongate U-shaped handle 30 is secured to the top wall 28 of the tank 26 by means of screws 32. The handle 30 has a central recessed area 34 adapted to be grasped by the hand of the mason to move the tool in a direction parallel to the side edges 14 and 20.

A water spray nozzle 36 having a built-in filter 38 is provided in a suitable recess 40 in one end of the handle 30, and is positioned to direct a fan spray of water downwardly and outwardly beyond and end 16 of the blade 10. A supply hose or conduit 42 extends downwardly into the water tank 26 through on opening 44 in the top wall 28 and is connected to an elbow 46 leading to a conduit 48 through an end of the U-shaped handle 30, which end is opposite to the end of the handle fitted with the nozzle 36.

The conduit 48 is provided with a one-way check valve 50 to allow flow of water only away from the tank 26, and said conduit 48 leads into one end of a flexible pump bulb 52. The pump bulb is disposed beneath the recess 34 and is exposed to the exterior of the handle to allow manual operation as the handle is being grasped to manipulate the tool.

The other end of the handle 30 is provided with a downwardly sloping conduit 54, which is connected through a second one-way check valve 56 to the other end of the bulb 52. The valve 56 restricts flow of water to a direction from the bulb 52 to the nozzle 36. The nozzle 36 is located above the ball 52 to prevent excessive dripping when the pump is not in use.

The bulb 52, together with the associated check vanes 50 and 56 at its inlet and outlet, provide a manually operated pump to allow delivery of water under pressure from the tank 26 to the nozzle 36 in controlled volumes and at desired times. The bulb 52 is located in the central region of the handle 30 where the handle is grasped to allow convenient manual operation by the hand while the tool is being used and guided by the same hand.

The pumping mechanism is primed by squeezing the bulb 52 until the bulb is filled with water. Release of the bulb provide suction to draw in water, and continued squeezing of the bulb causes water to be forced from the nozzle 36. A squeeze bulb pump is deemed to be superior because piston-type pumps might tend to clog or become contaminated with cement. The tank 26 may be provided with a removable plug 58 to enable refilling.

If the blade 10 is provided with a curved or edging surface along one edge 20, as shown, it is desirable to have the water spray directed toward the intended direction of movement of the blade, which is to the left when viewing FIGS. 1 and 2, so that fresh cement to be smoothed and finished can be first sprayed with water.

If the tool is being used in the other direction, or to the right, it is desirable to have the spray emitted from the corresponding side of the tool.

The pivot 28 allows the handle and tank assembly to be rotated 180 degrees relative to the blade, such that the spray nozzle 36 would be directed to the right instead of the left, as shown in the drawings.

Means are preferably provided to allow locking of blade 10 relative to the handle and tank assembly. As shown, this may comprise a threaded plunger assembly 60 having a handle 62 extending down through the tank and engaging in one of a pair of opposed openings 64 or 66, to releasably lock the handle and tank assembly in either of the appropriate positions.

We claim:

1. A hand operated tool for the smoothing of concrete surfaces, said tool comprising a downward facing smoothing blade comprising a flat rectangular portion with elongated side edges, one of said side edges being curved downwardly, and a pair of opposed ends, an upper handle means for manipulating said blade, a water supply tank between the blade and handle means, a spray nozzle on said tool directed downwardly at an angle beyond one of said ends, and conduit between said tank and spray nozzle, and pump means on said conduit for delivering water from said tank to said spray nozzle under pressure.

2. The hand operated tool of claim 1 additionally comprising means for moving and spray nozzle from one of said ends to the other.

3. The hand operated tool of claim 2 wherein the means for moving said spray nozzle means from one of said ends to the other comprises a pivot between said handle means and said blade.

4. The hand operated tool of claim 1 wherein said spray nozzle and pump means are located on said handle.

* * * * *